US005137176A

United States Patent [19]

Martineau et al.

[11] Patent Number: 5,137,176

[45] Date of Patent: Aug. 11, 1992

[54] ATTACK PREVENTION METHOD

[76] Inventors: Paul P. Martineau; Anne E. Martineau, both of P.O. Box 242, Pocasset, Mass. 02559

[21] Appl. No.: 570,419

[22] Filed: Aug. 21, 1990

[51] Int. Cl.[5] ..... B67B 7/00; G01F 11/00; A23G 3/30; B65D 85/02

[52] U.S. Cl. ..... 222/1; 222/175; 206/524.1; 424/408; 426/5

[58] Field of Search ..... 222/175, 206, 215, 1; 604/306; 109/29, 32; 42/1.08, 1.09, 1.11; 424/405, 408, 411, 414, 416, 417, 435, 439–442, 463; 428/321, 321.1; 514/890, 920; 99/382, 383, 450.7; 206/83, 528, 529, 530, 525, 524.1, 532, 634; 426/85, 86, 90, 91, 115, 138, 143, 5, 135, 76

[56] References Cited

U.S. PATENT DOCUMENTS

| | | | |
|---|---|---|---|
| 810,210 | 1/1906 | Laws | 426/5 |
| 991,354 | 2/1911 | Parent | 426/115 X |
| 1,752,001 | 3/1930 | Horra | 426/279 |
| 1,792,010 | 2/1931 | Gross | 206/524.6 X |
| 1,810,453 | 6/1931 | Webster et al. | 426/5 |
| 1,983,461 | 12/1934 | Howett | 109/32 |
| 2,134,489 | 10/1938 | Scherer | 206/530 X |
| 2,334,600 | 11/1943 | Boysen | 206/634 X |
| 3,071,476 | 1/1963 | Werft et al. | 426/115 X |
| 3,334,790 | 8/1967 | Eaton | 426/115 X |
| 3,894,154 | 7/1975 | Graff et al. | 426/5 |
| 4,058,237 | 11/1977 | Luke | 222/175 X |
| 4,061,249 | 12/1977 | Smith | 109/32 X |
| 4,135,645 | 1/1979 | Kimmell | 222/83 |
| 4,241,850 | 12/1980 | Speer | 42/1.09 X |
| 4,250,196 | 2/1981 | Friello | 426/5 |
| 4,252,829 | 2/1981 | Terrevazzi | 426/5 |
| 4,308,976 | 1/1982 | Speer et al. | 222/175 X |
| 4,316,338 | 2/1982 | Mason | 42/1.08 |
| 4,409,244 | 11/1983 | Cherukuri et al. | 426/5 |
| 4,428,506 | 1/1984 | Withey | 222/175 |
| 4,543,769 | 10/1985 | Schmitz | 426/5 X |
| 4,667,851 | 5/1987 | Wilkerson | 222/175 X |
| 4,816,260 | 3/1989 | Wolbrich | 424/463 |
| 4,902,519 | 2/1990 | Ream et al. | 426/5 X |
| 5,000,347 | 3/1991 | Tran | 222/1 |

OTHER PUBLICATIONS

Johnson Smith & Co., Catalog of Novelties, 1961.

*Primary Examiner*—Michael S. Huppert
*Assistant Examiner*—Kenneth DeRosa
*Attorney, Agent, or Firm*—Thomas A. Kahrl

[57] ABSTRACT

A self defense method, particularly for women, for defending against a physical assailant. The method comprising providing a wax capsule of hollow egg shaped construction containing a concentrated citric acid solution in the inner enclosed cavity to be carried in the mouth without releasing the citric acid until desired. The user, by simply chewing through the wall of the wax container releases the citric acid into his/her mouth for expectoration into the eyes of a would be attacker. The wax used in the capsule construction to provide an encapsulating capsule, preferably consists of purified wax.

2 Claims, 1 Drawing Sheet

ATTACK PREVENTION METHOD

BACKGROUND OF THE INVENTION

Personal defense articles providing protection particularly for women are known which release substances typically a noxious fluid having an offensive odor such as a skunk odor which are offensive to an assailant and accordingly provide temporary defense against a potential assault. Typically such personal protection devices provide for a release of noxious fluid from an encapsulating device by puncturing or breaking the device thereby releasing the within-contained noxious fluid which evaporates and produces and overpoweringly offensive odor.

Various personal protection devices have been proposed, including devices for releasing strong odors by fracturing a capsule, such as for example, as described in U.S. Pat. Nos. 4,135,645, 4,428,506 and 4,816,260 which provide for release of offensive odors by fracturing an encapsulating container.

It is desirable to provide for a new and improved attack prevention device and a method for preventing attack which is designed to prevent attack by an assailant more efficiently and effectively, which is readily concealed, quick to use and which while effective is not offensive to the user.

SUMMARY OF THE INVENTION

The invention relates to an attack prevention device and method of preventing an assault by an assailant by employing the device of the invention.

A unique and novel attack prevention device has been discovered for preventing an assault by an assailant, which incorporates a capsule adapted to be grasped by a user for insertion in the user's oral cavity, the capsule having a frangible wall section, typically having a cocoon type construction, a smooth rounded outer surface and a hollow cavity for sealably containing an acid solution, typically a citric acid solution, the wall section being of molded construction of material such as wax to prevent the acid from leaking out of the capsule and into the user's mouth, wherein, upon the hostile approach of a potential assailant, the capsule may be chewed by the user thereby releasing the citric acid into the user's mouth to permit the user to expectorate the citric acid into the eyes and face of the prospective assailant thereby rendering the assailant incapacitated and permitting the user to escape from the threatened encounter. The acid solution comprises a citric acid.

A method of storage and controlled release of acid solution has been discovered for repelling an assault by an assailant in an efficient, rapid method., which method comprises encapsulating acid solution in the capsule; placing the capsule having an encapsulating wall constructed of frangible material characterized by an inner cavity containing an acid solution in the oral cavity of a user; storing the acid solution encapsulated in the capsule in the oral cavity of a user for an extended period of time, chewing the capsule causing the frangible wall to fracture and releasing the acid into the mouth of the user upon the approach of a threatening assailant; and ejecting the acid from the user's mouth into the eyes of the assailant.

A unique and novel attack prevention device has been discovered for preventing an assault by an assailant, which incorporates a capsule adapted to be grasped by a user for insertion in the user's oral cavity, the capsule having a frangible wall section, a smooth rounded outer surface, a hollow cavity for sealably containing an acid solution, the wall section of molded construction of material such as wax to prevent the acid from leaking out of the capsule and into the user's mouth wherein upon the hostile approach of a potential assailant, the capsule may be chewed by the user releasing the acid into the user's mouth to permit the user to expectorate the acid into the eyes of the prospective assailant. The acid solution comprises a citric acid.

A method of storage and controlled release of acid solution has been discovered for repelling an assault by an assailant in an efficient, rapid method., which method comprises placing a capsule having an encapsulating wall constructed of frangible material enclosing an inner cavity containing an acid solution in the mouth of a user as described; encapsulating acid solution in the capsule; storing the acid solution encapsulated in the capsule in the mouth of a user for an extended period of time; chewing the capsule causing the wall to fracture and releasing the acid into the mouth of the user upon the approach of a threatening assailant; ejecting the acid from the user's mouth into the eyes of an assailant.

The invention will be described for the purposes of illustration only in connection with certain embodiments; however, it is recognized that those persons skilled in the art may make various changes, modifications, improvements and additions on the illustrated embodiments all without departing from the spirit and scope of the invention.

DESCRIPTION OF THE EMBODIMENTS

Figure 1:
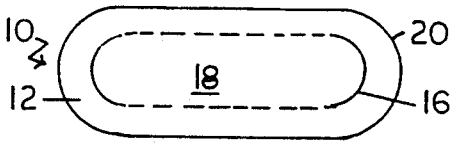
FIG. 1 is a perspective view from the side of the attack prevention device of the invention.
Figure 2:
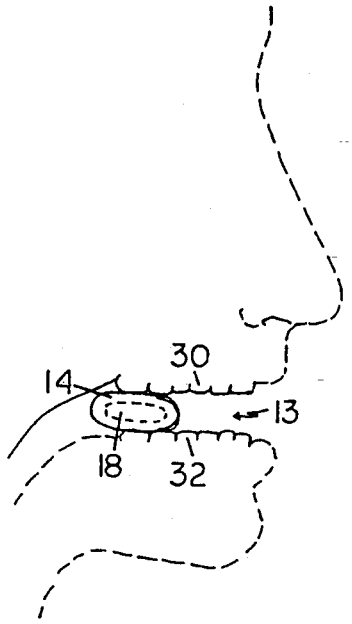
FIG. 2 is a side sectional view of the invention of the attack prevention device in FIG. 1.
Figure 3:
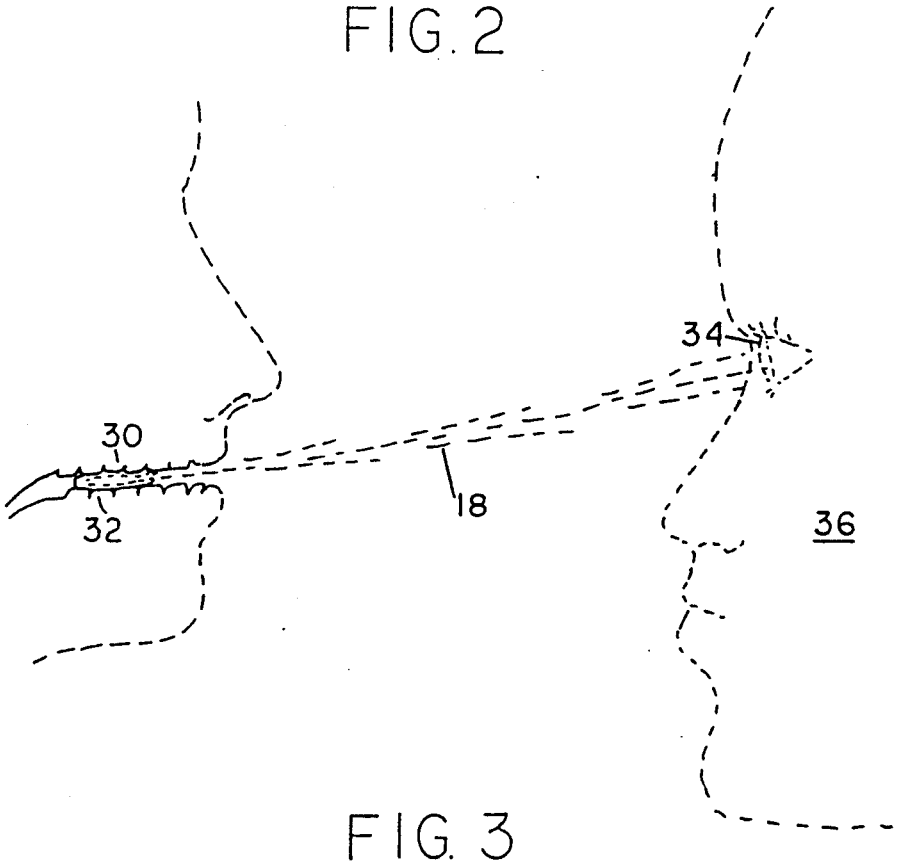
FIG. 3 is a schematic illustration of the employment of the attack prevention device of FIG. 1 in the side elevational view of the attack prevention device stored in the oral cavity showing the face of the assailant.

FIG. 1 shows an attack prevention device 10 of the invention which comprises a capsule 12 adapted to be grasped by the user for insertion in the user's oral cavity, the capsule 12 having a wall member 14 encompassing a hollow interior cavity 16 for sealably containing an acid solution 18. The capsule includes a smooth outer surface 20 being rounded and smooth of a generally elliptical shape. The wall 14 constructed of frangible material such as wax which is nonsoluable and will not dissolve in the oral cavity of the user, typically of cocoon type construction, and constructed to provide a sealed storage of the within contained acid solution 18 for an extended periods of time within the oral cavity. The wall 14 usually is formed for example of molded wax to prevent acid from leaking out of the capsule and into the user's mouth or oral cavity. The capsule typically is stored by the user in the oral cavity 13 adjacent a lower row of teeth 30 and an upper row of teeth 32 to permit chewing of the capsule 18 upon very short notice upon the advent of a threatened attack, breaking the frangible wall 14, releasing the acid solution from encapsulation into the oral cavity and permitting expectoration by the user from the oral cavity through the user's lips into the eyes 32 of an assailant 36.

What is claimed is:

1. A method for concealed storage of an acid solution for use in attach prevention comprising the steps of:

a) providing a mouth and an oral cavity of a user;

b) providing an attack prevention device in the form of a capsule, said capsule having a frangible encapsulating wall constructed of soft pliable wax material and an inner cavity;

c) encapsulating a fluid repellant in said capsule by filling the inner cavity with said acid solution, said acid solution being non-harmful to the internal skin of the user's mouth;

d) placing said capsule in the oral cavity of the user to be concealedly carried in a space provided between the gum and the inner cheek surface adjacent the tongue and the teeth of the user;

e) moving the capsule by articulation of the user's tongue and positioning the capsule between the upper and lower teeth of the user and thereupon chewing the capsule thereby rupturing said wall releasing said acid solution into the mouth of the user; and f) expelling outwardly and directionally into the eyes of a potential assailant said acid solution.

2. The method of claim 1 wherein the acid solution means comprises citric acid for self defense.

* * * * *